US007212468B2

(12) United States Patent
Shemesh et al.

(10) Patent No.: US 7,212,468 B2
(45) Date of Patent: May 1, 2007

(54) MASTER/SLAVE CLOCK SYSTEM WITH AUTOMATIC PROTOCOL DETECTION AND SELECTION

(75) Inventors: Ilan Shemesh, Huntingdon Valley, PA (US); J. Scott Barnes, Wenonah, NJ (US)

(73) Assignee: The Sapling Company, Inc., Huntingdon Valley, PA (US)

( * ) Notice: Subject to any disclaimer, the term of this patent is extended or adjusted under 35 U.S.C. 154(b) by 252 days.

(21) Appl. No.: 10/742,271

(22) Filed: Dec. 19, 2003

(65) Prior Publication Data

US 2004/0165480 A1 Aug. 26, 2004

Related U.S. Application Data

(60) Provisional application No. 60/434,626, filed on Dec. 19, 2002, provisional application No. 60/439,586, filed on Jan. 13, 2003.

(51) Int. Cl.
*G04C 13/08* (2006.01)

(52) U.S. Cl. ..... 368/59; 368/46

(58) Field of Classification Search ..... 368/46, 368/28, 59, 55–58, 47
See application file for complete search history.

(56) References Cited

U.S. PATENT DOCUMENTS

| | | | | |
|---|---|---|---|---|
| 5,323,803 | A * | 6/1994 | Blumenauer | 137/337 |
| 5,805,530 | A * | 9/1998 | Youngberg | 368/47 |
| 6,205,090 | B1 | 3/2001 | Blount et al. | |
| 2003/0063525 | A1 | 4/2003 | Richardson et al. | |
| 2004/0179432 | A1 * | 9/2004 | Burke | 368/46 |

* cited by examiner

*Primary Examiner*—Vit Miska
*Assistant Examiner*—Sean Kayes
(74) *Attorney, Agent, or Firm*—Lucas & Mercanti, LLP

(57) ABSTRACT

Disclosed is a method for automatically detecting and selecting a time correction protocol and a time base, from among many possible protocols, in a master/slave clock system. A "self-teaching" feature is also disclosed, which includes a table stored at the slave clock containing data representative of characteristics, such as the relative frequency and spacing, of each one of numerous different time correction pulses that can be received by the slave clock from the master clock. Then, at a time of time correction, the slave clock selects the protocol most likely being used by the master clock, based on historical data. The time displayed by the slave clock is the then updated to match the time displayed by the master clock.

27 Claims, 9 Drawing Sheets

MASTER/SLAVE CLOCK SYSTEM WITH AUTOMATIC PROTOCOL DETECTION AND SELECTION

CROSS-REFERENCE TO RELATED APPLICATIONS

This application is entitled to the benefit of U.S. Provisional Patent Application Ser. No. 60/434,626, filed Dec. 19, 2002, and U.S. Provisional Patent Application Ser. No. 60/439,586, filed Jan. 13, 2003. Such applications are incorporated herein by reference.

FEDERALLY SPONSORED RESEARCH

Not Applicable

SEQUENCE LISTING OR PROGRAM

Not Applicable

BACKGROUND OF THE INVENTION

The present invention pertains to a timekeeping system commonly used in schools, hospitals, offices and industrial applications.

Many timekeeping systems are comprised of a master clock driving one or more "slave" or secondary clocks that are periodically updated to be time synchronous to the master. Older systems did not have the benefit of microprocessor technology, as do units produced today. In modern systems, both the master and secondary clocks frequently contain microprocessors, and it is advantageous to utilize this intelligence when performing installation and time correction. Secondary clocks in these systems may have either the traditional analog face or a digital display, or both.

Normally, timekeeping systems have several protocols, such as sync-wire 59 minute correction, sync-wire 58 minute correction, sync-wire National Time and Rauland correction, 2-wire digital communication, 3-wire digital communication, RS-485, and others. Currently, there are upwards of 40 or 50 different protocols in use around the world. Some are quite common whereas others are rarely used. These protocols frequently operate sending one or more voltage pulses from the master clock to the secondary clocks or sending data transmission from the master clock to the secondary clock. Depending on the protocol, the pulses vary in signal timing, such as pulse width, repetition rate, etc., that add complication when the system is first installed or new secondary clocks are later added to the system. Each secondary clock is capable of several protocols that must be set correctly at the time of installation.

Currently during system installation and correction, there are no tools available that automatically detect and select the correct protocol at the secondary clocks. In Blount et al. U.S. Pat. No. 6,205,090, there is disclosed an adjustable master/slave clock system having a time keeping correction apparatus that may be used to select among several time keeping correcting schemes, such as a $59^{th}$ minute correction scheme, a $58^{th}$ minute correction scheme and a National Time correction scheme. The correction scheme is not, however, automatically detected or selected by the clock system itself. Rather, the particular scheme desired must be manually selected by a user, such as with a switch. This is a time-consuming and error-prone chore for the user, particularly if numerous secondary clocks, each based on a different protocol, are added to the system after initial installation.

SUMMARY OF THE INVENTION

To overcome the disadvantages of the prior art, disclosed is a method for automatically detecting and selecting a time correction protocol and a time base, from among many possible protocols, in a master/slave clock system. A "self-teaching" feature is also disclosed, which includes a table stored at the slave clock containing data representative of characteristics, such as the relative frequency and spacing, of each one of numerous different time correction pulses that can be received by the slave clock from the master clock. Each time a pulse pattern from the master clock is sensed by the slave clock, the relative frequency and temporal spacing of the input pulses are stored in a statistical buffer. Then, at a time of time correction, the slave clock selects the protocol most likely being used by the master clock, based on historical data stored in a statistical buffer at the slave clock. The time displayed by the slave clock is then updated.

More particularly, in one embodiment, the invention comprises a master/slave clock system, comprising:

a master clock coupled to at least one slave clock, the master clock including means for transmitting a plurality of pulses to the slave clock; and means within the slave clock for receiving the plurality of pulses and storing historical data descriptive of the pulses.

In another embodiment, the invention comprises a master/slave clock system for the automatic detection and selection of time-correction protocols, comprising:

a master clock coupled to at least one slave clock, the master clock including means for transmitting a plurality of pulses in a pattern representative of a time correction protocol used by the master clock;

means at the slave clock for receiving the pulses and storing data representative of characteristics of the pulses received at the slave clock;

means at the slave clock for performing an analysis of the data at the slave clock to determine which time correction protocol has been used most frequently by the master clock during a predetermined period of time in the past;

means at the slave clock for selecting the protocol for the slave clock that best matches the protocol determined to be in use by the master clock; and executing the protocol at the slave clock so as to synchronize a time displayed by the slave clock with a time displayed by the master clock.

In another embodiment, the data stored at the slave clock includes data representative of one or more of the following characteristics of the pulses: frequency of occurrence of the pulses, width of the pulses, time between pulses, polarity of the pulses, and whether the pulses are sent by AC or DC current.

In another embodiment, the protocol used by the master clock comprises any one of the following protocols: 58th minute correction, 59th minute hourly correction, 59th minute daily correction, National Time and Rauland hourly correction, or National Time and Rauland daily correction, or impulse correction.

In another embodiment, the protocol selected for the slave clock is displayed at the slave clock.

In another embodiment, the protocol for the slave clock is selected whether or not the pulse pattern displays normal or inverted electrical signal polarity In another embodiment, the invention comprises a clock adapted for use in a master/slave clock system, comprising:

a slave clock including a microprocessor and means for displaying time; and means within the slave clock for receiving a plurality of pulses transmitted by a master clock and for storing historical data representative of characteristics of the pulses.

In another embodiment, the invention comprises a clock for use in a master/slave clock system, comprising:

a slave clock adapted to be coupled to a master clock;

means at the slave clock for receiving a plurality of time correction pulses sent by the master clock in a pattern representative of a time correction protocol used by the master clock;

means at the slave clock for storing data representative of characteristics of the pulses received at the slave clock;

means at the slave clock for performing an analysis of the data at the slave clock to determine which time correction protocol has been used most frequently by the master clock during a predetermined period of time in the past;

means at the slave clock for selecting the protocol for the slave clock that best matches the protocol determined to be in use by the master clock; and executing the protocol at the slave clock so as to synchronize a time displayed by the slave clock with a time displayed by the master clock.

In another embodiment, the invention comprises a clock for use in a master/slave clock system, comprising:

a slave clock adapted to be coupled to a master clock; and means at the slave clock for automatically displaying a time correction protocol in use by the slave clock.

In another embodiment, the invention comprises a clock for use in a master/slave clock system, comprising:

a slave clock adapted to be coupled to a master clock; and means at the slave clock for automatically detecting a 50 Hz or 60 Hz time base.

In another embodiment, the invention comprises a clock for use in a master/slave clock system, comprising:

a slave clock adapted to be coupled to a master clock; and means at the slave clock for receiving a plurality of time correction pulses from the master clock and for automatically displaying the pulses in real time as the pulses are being received by the slave clock.

In another embodiment, the invention comprises a method for automatically detecting and selecting a time correction protocol for use within a master/slave clock system, comprising the steps of:

(a) receiving a plurality of pulses in a pattern sent by a master clock to a slave clock, each pattern representing one of a plurality of time correction protocols; and (b) storing data at the slave clock, the data representative of characteristics of the pulses received at the slave clock during a predetermined period of time in the past.

In another embodiment, the invention comprises a method for automatically detecting and selecting a time correction protocol for use within a master/slave clock system, comprising the steps of:

(a) receiving pulse patterns sent by a master clock to a slave clock, each pulse pattern representing a time correction protocol used by the master clock;

(b) storing data at the slave clock, the data representative of characteristics of the pulse patterns received at the slave clock during a predetermined period of time in the past;

(c) performing an analysis of the data at the slave clock to determine the protocol most likely in use by the master clock;

(d) selecting a time correction protocol for the slave clock that has the highest probability of being the protocol used by the master clock in the past, via continuous self-teaching and analysis of the data; and (e) automatically synchronizing a time displayed by the slave clock with a time displayed by the master clock using the protocol for the slave clock.

In another embodiment, the invention comprises a master/slave clock system for the automatic detection and selection of time-correction protocols, comprising:

a master clock coupled to at least one slave clock, the master clock including means for transmitting pulses to the slave clock representative of a time correction protocol, and the slave clock including means for receiving the pulses;

a microprocessor within the slave clock and operating under the control of software stored within a memory in the microprocessor, the microprocessor configured to control slave clock functions;

a memory within the slave clock for storing data representative of characteristics of the pulses received at the slave clock;

a processor at the slave clock for performing an analysis of the data at the slave clock to determine which pulse patterns have been transmitted most frequently by the master clock in the past; and whereby the microprocessor is further configured to automatically select a particular time correction protocol that has the highest probability of being the protocol used by the master clock during a predetermined period of time in the past, via continuous self-teaching and analysis of the data, and to automatically synchronize a time displayed by the slave clock with a time displayed by the master clock using the selected protocol.

BRIEF DESCRIPTION OF THE DRAWINGS

These and other features and advantages of the invention will now be described with reference to the drawings of certain preferred embodiments, which are intended to illustrate and not to limit the invention, and in which like reference numbers represent corresponding parts throughout, and in which.

DETAILED DESCRIPTION OF THE INVENTION

Summary of Features

Some of the significant features of a preferred embodiment of the present invention may be summarized as follows: First, software functionality contained in the secondary or slave clocks of a timekeeping system (see FIG. 1) includes the capability to automatically adjust and set the both the time base (such as 60 Hz, 50 Hz or processor time base) and the communication protocol required by the slave clock to operate in a given system. The slave clock stores data describing or representing certain characteristics of input pulses in a statistical buffer at the slave clock. The slave clock determines the master clock's protocol by a "self-teaching" analysis of existing and historical conditions and characteristics of pulses sent by the master, such as pulse sequence, pulse frequency and pulse width, received by the slave clock during operation. In addition, the statistical buffer can store not just the frequency of the pulse and time between pulses, but it also store the polarity of the pulses. These features allow the slave clock to perform "self-teaching" on the input data and to select the "best" or most probable protocol pulses that have been sent from the master.

Second, software functionality contained in the secondary clocks includes the capability to optionally display the communication protocol selected by the secondary clock. This display may include, but is not limited to, the hands of the analog clock movement or an encoded message via a LED or equivalent device.

Third, software functionality contained in the secondary clocks includes the capability to allow the scanning of communication protocols to be used by the process described above. input (time correction or protocol) pulses received from the master clock. Data representative of one or more of the following characteristics are stored: frequency of the pulses, width of the pulses, time between pulses, polarity of the pulses, and whether the pulses are sent by AC or DC current. In another feature of the invention, a table 61 is included in a memory, preferably Program Memory 23, which is preferably a nonvolatile memory. Table 61 is a dedicated area for the storage of data representative of standard pulse characteristics used for all known standard protocols, including but not limited to: 58th minute correction, 59th minute hourly correction, 59th minute daily correction, National Time and Rauland hourly correction, National Time and Rauland daily correction, and impulse correction. Such data is entered into table 61 at the time of manufacture of the slave clock, or prior to installation or activation of the slave clock.

Method of Operation

Referring now to FIGS. 5–9, a preferred embodiment of the invention operates as follows, under the control of microprocessors in both the master and secondary clocks, running software contained in a memory in each clock.

Figure 5:
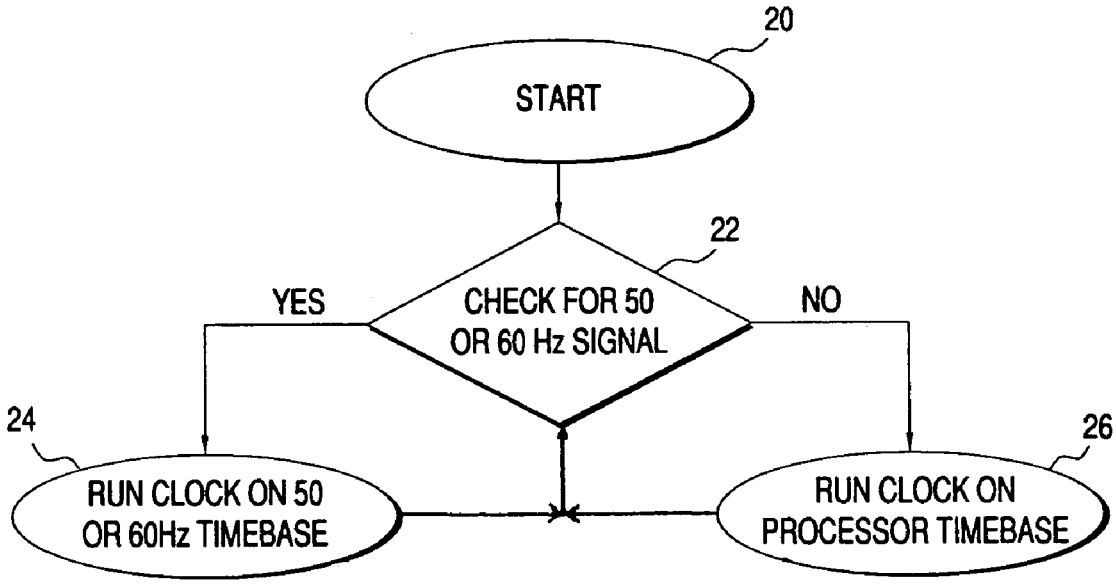
FIG. 5 is a flowchart showing the sequence of operations in one embodiment of the slave clocks for determining a time base.

FIG. 5 illustrates a sequence of operations for determining the time base to be used by the secondary clock(s). After power-up at the start of first operation after installation (step 20), the slave clock microprocessor first starts with an internal oscillator. Then, the microprocessor checks for the presence of a 60 Hz or 50 Hz AC electrical signal at step 22. If such a signal is detected, then a 60 Hz or 50 Hz time base is selected for all clocks at step 24, and operation returns to step 22. If no 60 Hz or 50 Hz signal is detected, the microprocessor internal time base (such as that determined by an oscillator) is selected at step 26, and operation returns to step 22.

Figure 3:
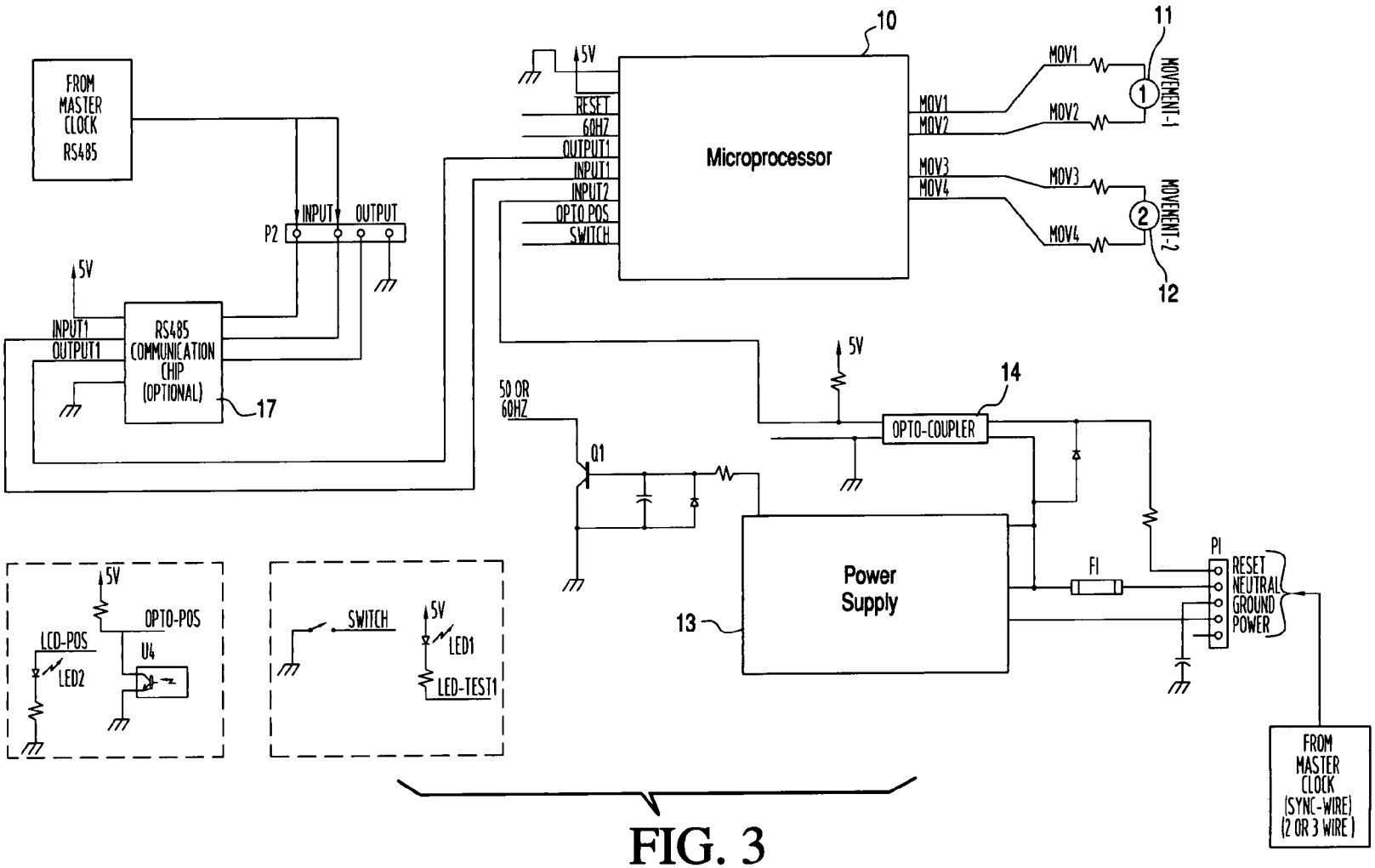
FIG. 3 is a combined block and electrical schematic diagram of one embodiment of a slave clock of the invention.
Figure 6:
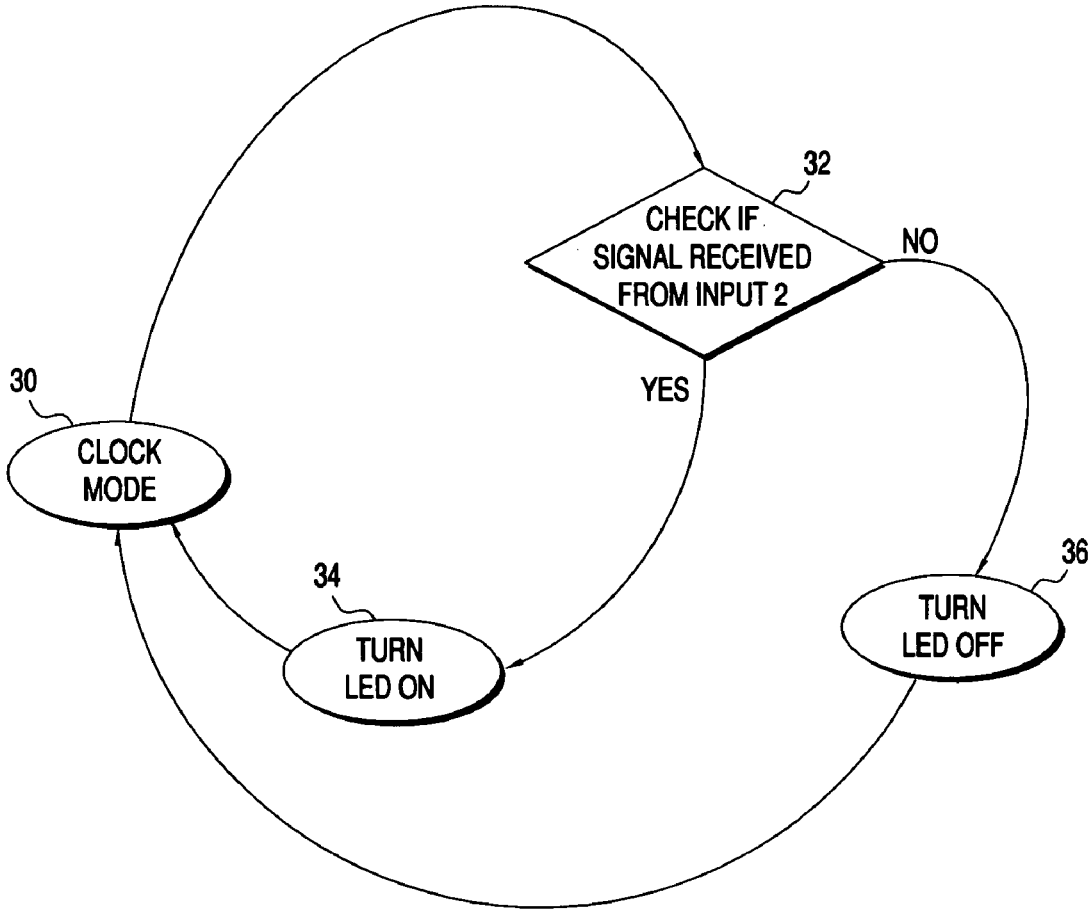
FIG. 6 is a flowchart showing the sequence of operations in one embodiment of the slave clocks for operating an LED indicator light.
Figure 7:
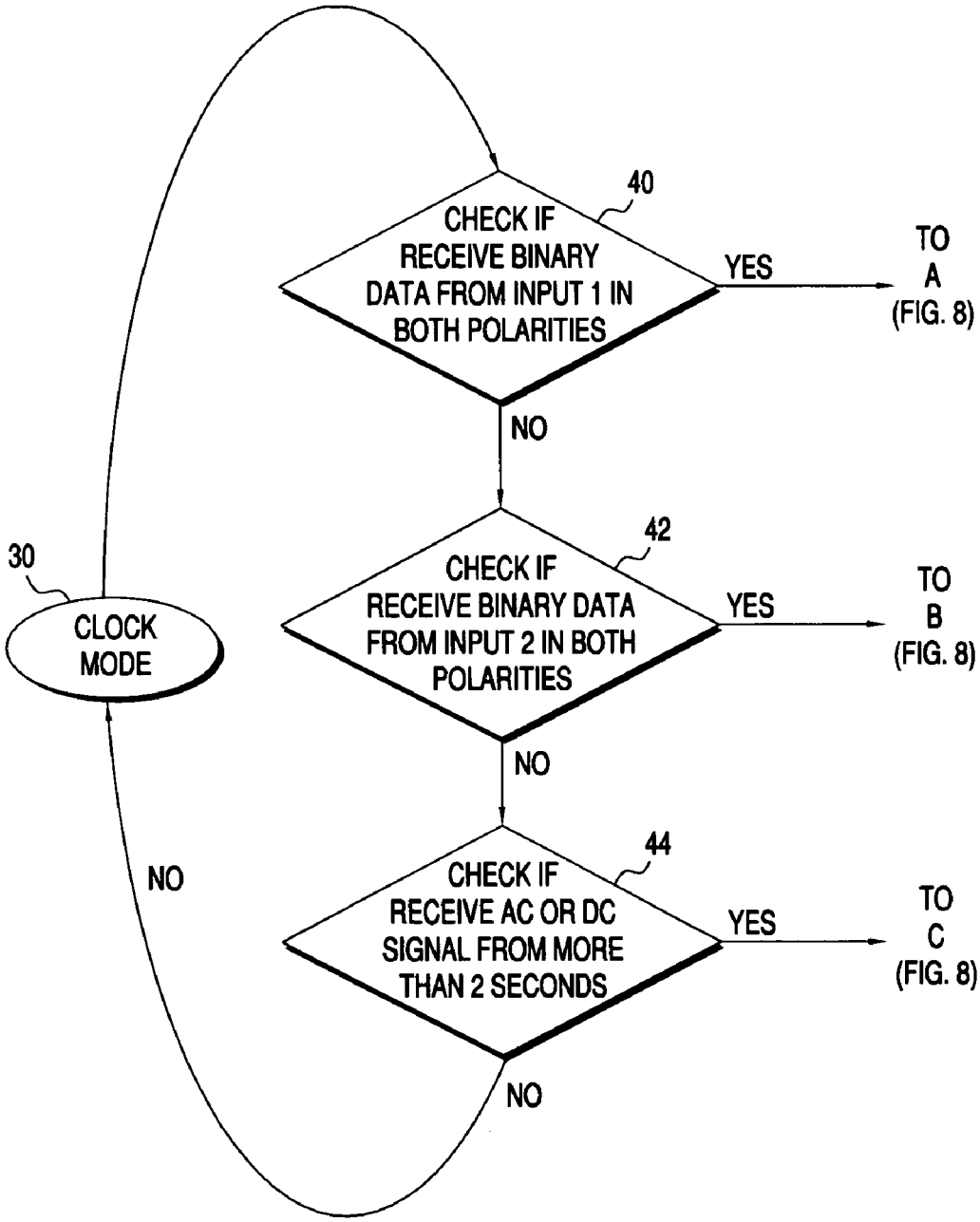
FIGS. 7–9, taken together, is a flowchart showing the sequence of operations in one embodiment of the slave clock for the automatic detection and selection of a time correction protocol used by the master clock.
Figure 8:
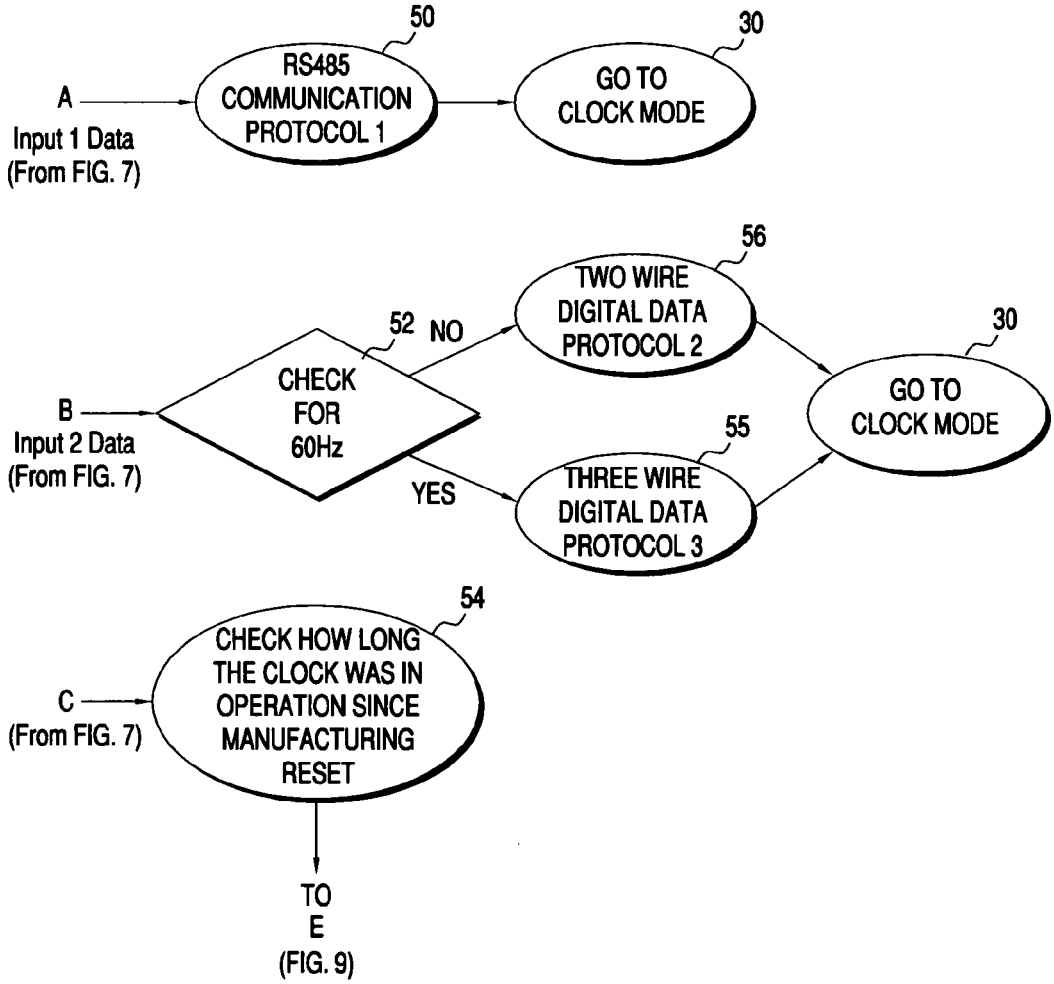

FIG. 6 is a flowchart showing the sequence of operations in one embodiment of the slave clock for operating an LED indicator light. The purpose of this light is to show the installer when the slave clock is receiving correction signal. While in "clock mode" 30, which is the normal clock operating mode, the microprocessor in each secondary clock checks at step 32 to see if a signal is received from input 2 (FIG. 3). If the signal is detected, LED test is illuminated at step 34, and operation returns to clock mode 30. If no signal is detected, LED test is turned off at step 36, and operation returns to clock mode 30.

Fourth, software functionality contained in the secondary clocks includes the capability to receive information about the communication protocol as sent by the master clock during installation.

Fifth, the invention also has the capability to check for the best protocol even if the pulse data is inverted.

Figure 1:
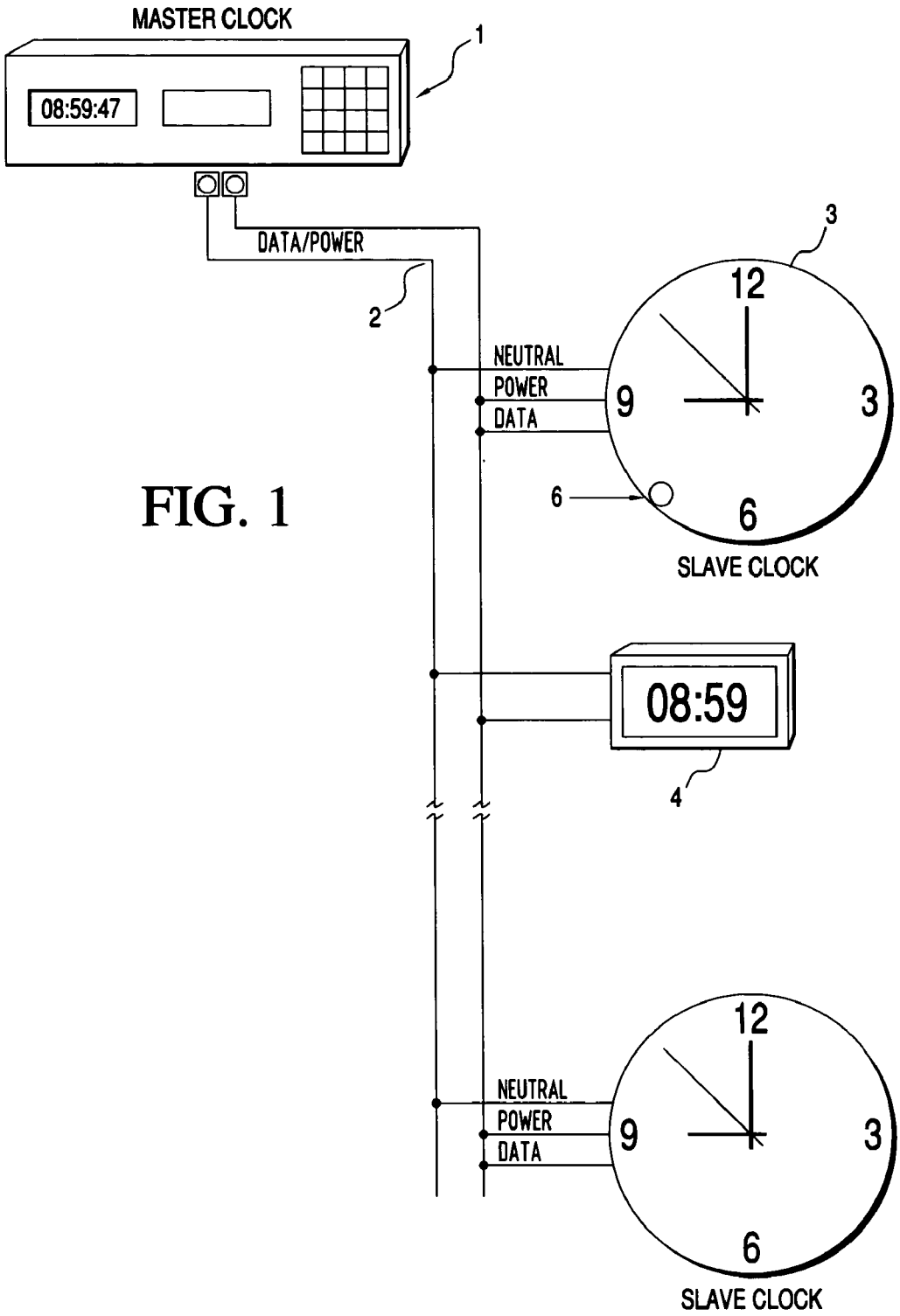
FIG. 1 is an overall block diagram of an embodiment of a two-wire timekeeping system of the present invention having master and secondary (slave) clocks.
Figure 2:
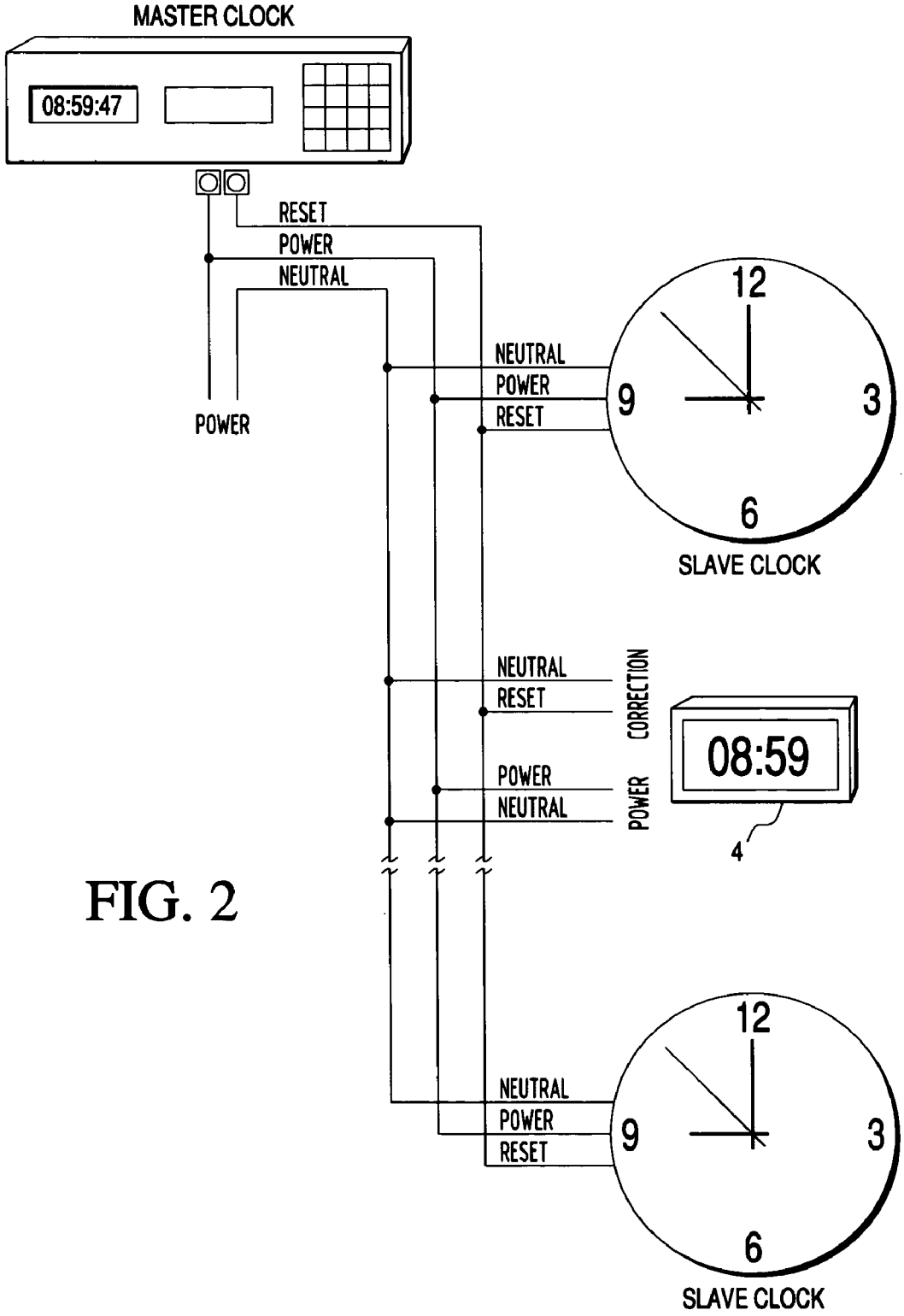
FIG. 2 is an overall block diagram of an embodiment of a three-wire timekeeping system of the present invention having master and secondary (slave) clocks.

Turning now to the drawings, FIGS. 1 and 2 show preferred embodiments of timekeeping systems of the invention, with master clock 1 connected to secondary clocks 3 and 4. Secondary clocks may have analog (3) or digital (4) displays. The master clock sends data to all secondary clocks. The clock system can also be connected via three wires using three wire digital communication or operating using a variety of sync wire protocols (FIG. 2). An indicator 6, which may be an LED or other light source, is shown for communication of clock status to installation personnel.

FIG. 3 shows a combined block and electrical schematic diagram of one embodiment of an analog slave clock of the invention. Processing is handled by a microprocessor 10 running microcode stored in an internal memory. In a preferred embodiment, microprocessor 10 may comprise model ST7FLITE2, manufactured by ST Microelectronics. A stepper motor 11 ("Movement_1") drives the second hand, and a stepper motor 12 ("Movement_2") drives the hour and minute hands. Connector P2 provides a connection to a master clock for receiving RS485 data that is communicated via INPUT1 via an optional RS485 communication chip 17 to the microprocessor. Transistor Q1 assists in determining the 60 Hz or 50 Hz time base. Opto-coupler 14 provides binary data or AC or DC pulses from the master clock from a "Reset" pin at terminal P1 to the microprocessor via an "INPUT2" connection. Microprocessor 10 may be programmed from the "outside world" through other terminals and connections (not shown).

Figure 4:
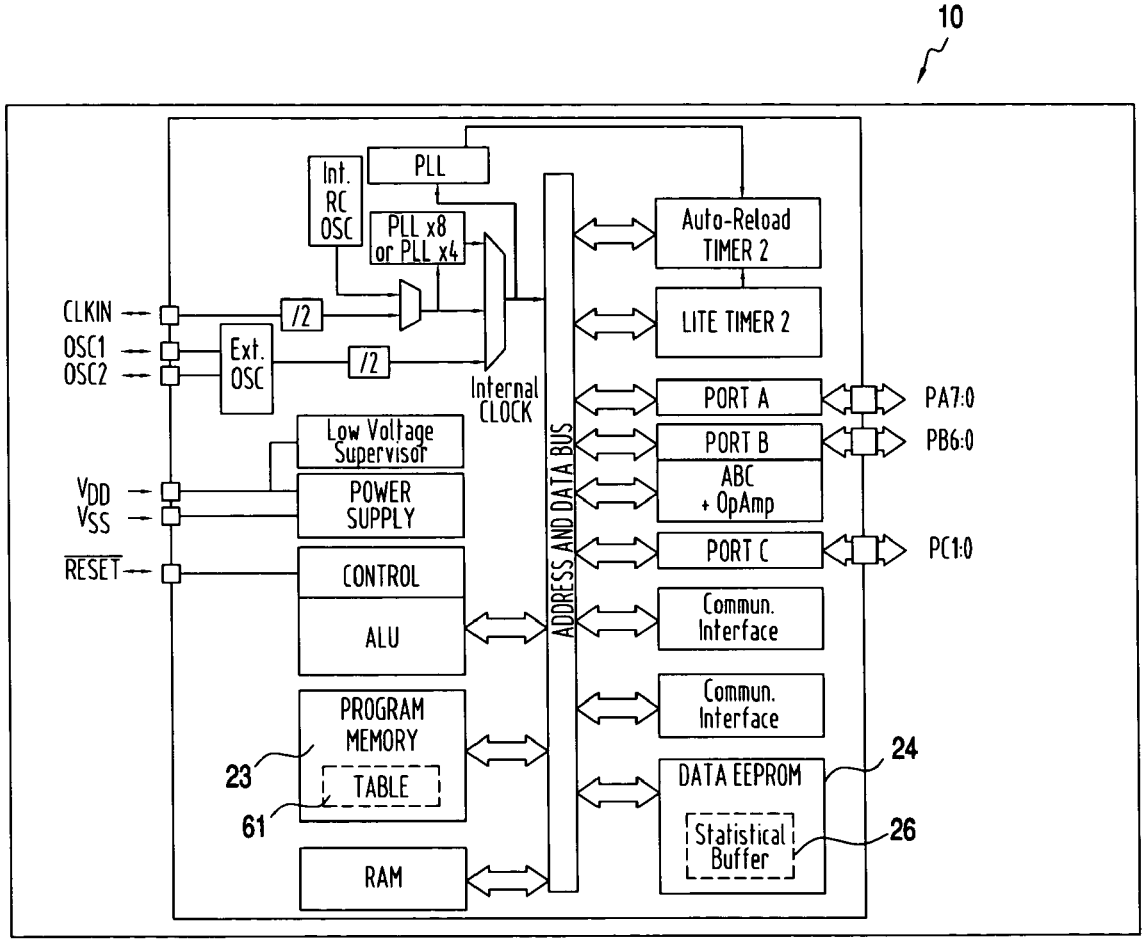
FIG. 4 is a block diagram showing the internal structure of microprocessor 10 of FIG. 3.

FIG. 4 is a block diagram showing the preferred internal structure of microprocessor 10 of FIG. 3. Microprocessor 10 includes an internal program memory, an ALU, RAM, and an EEPROM 24 for data storage. The elements shown in FIG. 4 are conventional parts of the commercially-available ST7FLITE2 product mentioned above, except as follows: In a feature of the invention, a statistical buffer 26 is included in a memory, preferably Data EEPROM 24, which is preferably a nonvolatile memory. Statistical buffer 26 is a dedicated area for the storage of data that describes and represents certain characteristics of Pulse Pattern Detection, Self-Teaching and Protocol Selection By way of background, most institutional time clock systems require a protocol so that individual secondary/slave/wall clocks become and stay synchronized with the master clock. Occasionally, the slave clocks may become unsynchronized. To correct this, the master clock will periodically send patterns of electrical pulses to the slave clocks at a time of time correction. The particular pattern of pulses, such as an 8-second pulses followed by a 14-second pulse, represents a particular communication protocol that is being used for the time correction. Some systems use patterns of "on" and "off" times or reverse polarity of an electrical signal as the basis of this protocol.

Many different pulse patterns and protocols exist, for example 58th minute correction, 59th minute hourly correction, 59th minute daily correction, National Time and Rauland hourly correction, National Time and Rauland daily correction, and impulse correction. If a new secondary clock is added to the system, the user may not know in advance which type of protocol is being used by the master clock. Thus, a need exists for a slave clock that is able to adapt to many different types of protocols.

In addition, some of the pulse patterns for different protocols are quite similar. Thus, unless measures are taken, this similarity may cause errors at the slave clock if the slave clock is using a different protocol than the master clock. Other difficulties may be presented if the width of the pulses from the master clock is not wide enough or within the tolerance for accurate detection by the slave clock. In addition, different master and slave clocks may be connected to the system at different times. Thus, a need exists for a method using a statistical distribution of pulse patterns to allow any slave clock to detect and select the protocol in use by any master clock currently in use on the system.

In a feature of the invention, Pulse Pattern Detection (PPD) is an algorithm in the wall or secondary clock to automatically identify which pulse-based protocol is in use by the master clock. This algorithm is illustrated in FIGS. 6–9, particularly FIG. 9.

The PPD algorithm is executed whenever the slave clock notes a changed electrical signal received from the master clock (either AC or DC). The slave clock provides two input parameters to the algorithm: the elapsed time since the last electrical signal change, and the new signal state (on or off). In turn, the algorithm provides two return values: the protocol type detected and the specific type of pulse within the context of the protocol. It is possible that the received signal was not recognizable, or was invalid within the context of the current active protocol; the algorithm can indicate these situations in the return value.

Figure 9:
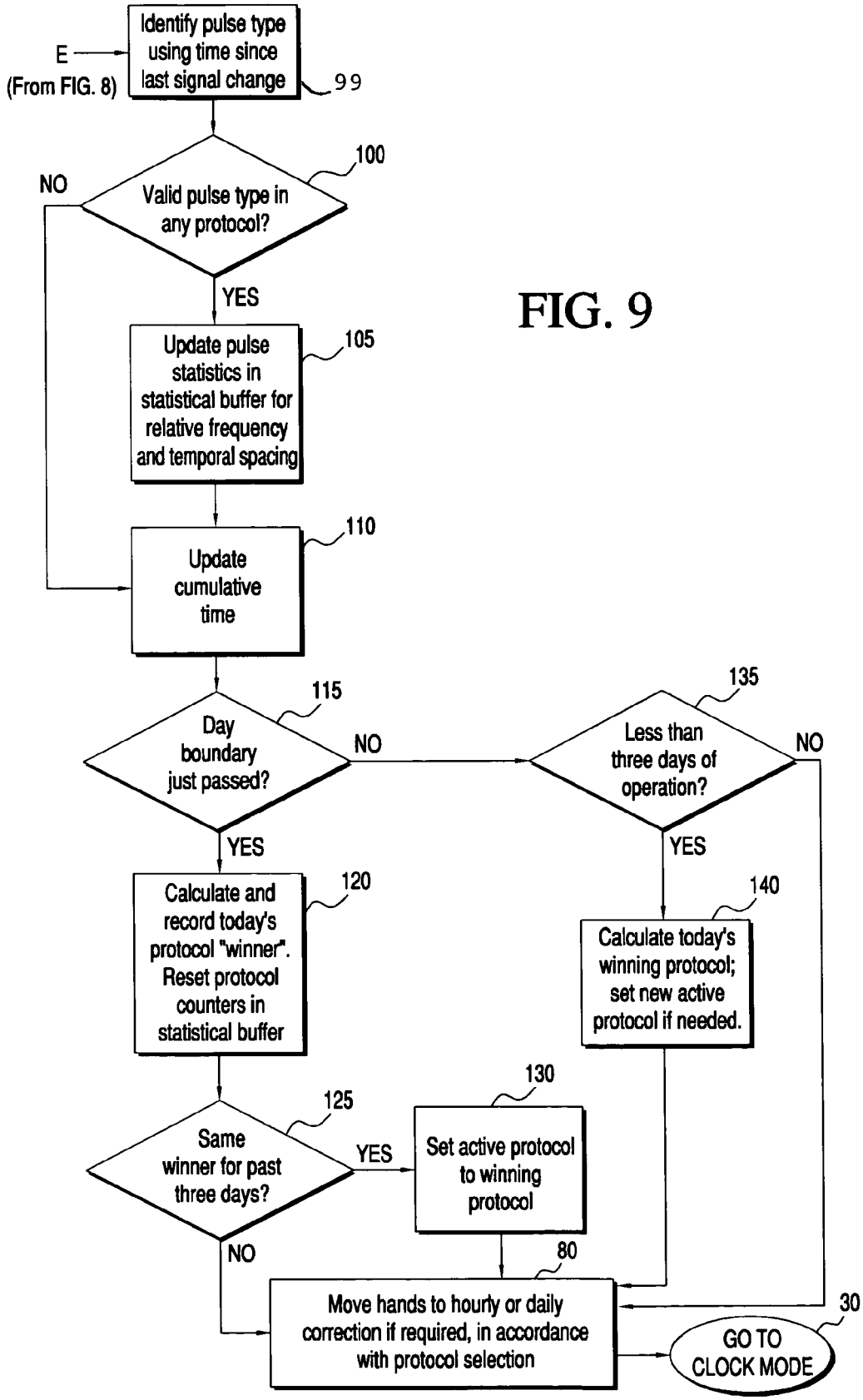

As shown in FIG. 9, the algorithm performs two initial steps each time it runs. First, it uses the time since the last signal change to identify which type of pulse occurred. The pulse time is compared against data in a table of pulse lengths used by all known protocols, in particular table 61 of microprocessor 10 (see FIG. 4). Each table entry specifies a minimum and maximum duration to account for implementation differences between various master clocks.

Second, if the pulse was of a known type, the algorithm updates statistics in the statistical buffer 26 (see FIG. 4) for the relative frequency and temporal spacing of that pulse type during the current 24 hour statistics period. In addition, the algorithm also detects and handles cases where the electrical signal polarity is inverted due to reversed wiring connections in the clock system.

At the end of each 24-hour statistics period, the algorithm compares data in the statistical buffer 26 with data in the table 61 to calculate and determine the "winning" protocol (i.e., the protocol most likely to be in use by the master clock) for the day by finding the best match to the pulse statistics collected that day. At all times, the algorithm remembers the winning protocols for the previous three days. When one particular protocol wins for three consecutive days, it becomes the active protocol for the clock. This data is also stored in the statistical buffer.

If the slave clock has been in operation for less than three days, the algorithm applies a special rule to enable the clock to synchronize "out of the box" without waiting for three days to elapse. In such cases, the algorithm selects the active protocol based on which protocol best matches the ongoing pulse statistic for the current 24-hour period.

A more detailed description of flowchart operations follows. Looking first at FIG. 7, while in normal clock mode 30, the system checks at step 40 to see if binary data has been received from input 1 (FIG. 3) in both polarities. If it has been, then the RS485 communication protocol 1 is selected at step 50 (FIG. 8), and the system is returned to clock mode 30. If not, the system next checks at step 42 (FIG. 7) to see if binary data has been received from input 2 in both polarities. If so, then the system checks at step 52 (FIG. 8) to see if the time base is 60 Hz or 50 Hz, and the system returns to clock mode 30. If not, then the two-wire digital data protocol 2 is selected at step 56, and the system returns to clock mode 30. If so, then the three-wire digital data protocol 3 is selected at step 58 and the system returns to clock mode 30. If binary data in both polarities has not been received from either input 1 or input 2, then the system checks at step 44 (FIG. 7) to see if an AC or DC signal having a duration longer than 0.1 second has been received. If not, the system returns to clock mode 30. If so, the system proceeds to step 99 (FIG. 9).

At step 99, the invention identifies the pulse type using the time elapsed since the last signal change. Then, at decision block 100 in FIG. 9, for each pulse received by the slave clock, the invention determines whether the pulse type and pattern is valid in any protocol (i.e., not noise or a spurious signal). If so, pulse statistics and protocol counters are updated in the statistical buffer for relative pulse frequency and temporal spacing at step 105, and then cumulative time (time elapsed since initial activation) is updated at step 110. If the pulse type is not valid, the counter incrementing step is bypassed.

Next, at step 115, it is determined whether a day boundary has just passed. If so, the current day's protocol "winner," or most likely protocol in use by the master clock, is calculated and recorded at step 120, and the protocol counters in the statistical buffer are reset. If the day boundary has not passed, then it is determined at step 135 whether the slave clock has been in operation less than three days. If so, the current "winning protocol" is calculated, and a new active protocol is set if needed, at step 140, and operation proceeds to step 80. At step 125, the invention determines whether the same protocol "winner" has been selected for the past three days. If so, then the invention assumes that this is the correct, permanent, active protocol. Then operation proceeds to step 80.

At step 80, after the appropriate protocol has been selected, then, at a predetermined time, time correction operation is automatically executed at the slave clock. Here, the slave clock hands are automatically moved (or the time is otherwise adjusted) to make an hourly or daily correction in accordance with the selected protocol. The system then returns to normal clock mode at step 30.

In summary, the present invention introduces considerable intelligence into a slave clock. The slave clock is not limited to only one protocol, and the protocol does not have to be manually set or pre-programmed by an operator. Accordingly, considerable versatility is introduced into master-slave clock systems.

What is claimed is:

1. A master/slave clock system, comprising: a master clock coupled to at least one slave clock, the master clock including means for transmitting a plurality of pulses to the slave clock, the pulses defining a clock synchronization protocol;

means within the slave clock for receiving the plurality of pulses and storing historical data descriptive of the pulses and means within the slave clock for automatically detecting and selecting the protocol.

2. The clock of claim 1, further comprising: an electric light display at the slave clock for automatically displaying a clock synchronization protocol in use by the slave clock without a need for a user to manually set a switch.

3. The clock of claim 1, further comprising: a processor at the slave clock for automatically detecting a 50 Hz or 60 Hz time base.

4. The clock of claim 1, further comprising: a processor at the slave clock for receiving a plurality of clock synchronization pulses from the master clock; and an electric light display at the slave clock for automatically displaying the pulses in real time as soon as each pulse is received by the slave clock.

5. The system of claim 1, in which the pulses are sent periodically by the master clock at a time of time correction in accordance with the protocol.

6. The system of claim 5, in which the data includes data representative of one or more of the following characteristics of the pulses: frequency of occurrence of the pulses, width of the pulses, time between pulses, polarity of the pulses, and whether the pulses are sent by AC or DC current.

7. The system of claim 6, in which the protocol comprises any one of the following protocols: 58th minute correction, 59th minute hourly correction, 59th minute daily correction, National Time and Rauland hourly correction, or National Time and Rauland daily correction, or impulse correction.

8. A master/slave clock system for the automatic detection and selection of a clock synchronization protocol, comprising:

a master clock coupled to at least one slave clock, the master clock including means for transmitting a plurality of pulses in a pattern representative of a clock synchronization protocol used by the master clock;

means at the slave clock for receiving the pulses and storing data representative of characteristics of the pulses received at the slave clock;

means at the slave clock for performing an analysis of the data at the slave clock to determine which clock synchronization protocol has been used most frequently by the master clock during a predetermined period of time in the past;

means at the slave clock for selecting the protocol for the slave clock that best matches the protocol determined to be in use by the master clock; and executing the protocol at the slave clock so as to synchronize a time displayed by the slave clock with a time displayed by the master clock.

9. The system of claim 8, in which the data includes data representative of one or more of the following characteristics of the pulses: frequency of occurrence of the pulses, width of the pulses, time between pulses, polarity of the pulses, and whether the pulses are sent by AC or DC current.

10. The system of claim 9, in which the protocol used by the master clock comprises any one of the following protocols: 58th minute correction, 59th minute hourly correction, 59th minute daily correction, National Time and Rauland hourly correction, or National Time and Rauland daily correction, or impulse correction.

11. The system of claim 10, in which the protocol selected by the slave clock is displayed at the slave clock.

12. The system of claim 11, in which the protocol for the slave clock is selected whether or not the pulse pattern displays normal or inverted electrical signal polarity.

13. A clock adapted for use in a master/slave clock system, comprising:

a slave clock including a microprocessor and means for displaying time;

means within the slave clock for receiving a plurality of pulses transmitted by a master clock, the pulses defining a clock synchronization protocol, and for storing historical data representative of characteristics of the pulses; and means within the slave clock for automatically detecting and selecting the protocol.

14. The clock of claim 13, in which the pulses are sent periodically by the master clock at a time of time correction in accordance with the protocol.

15. The system of claim 14, in which the data includes data representative of one or more of the following characteristics of the pulses: frequency of occurrence of the pulses, width of the pulses, time between pulses, polarity of the pulses, and whether the pulses are sent by AC or DC current.

16. The clock of claim 15, in which the protocol comprises any one of the following protocols: 58th minute correction, 59th minute hourly correction, 59th minute daily correction, National Time and Rauland hourly correction, or National Time and Rauland daily correction, or impulse correction.

17. A clock for use in a master/slave clock system, comprising:

a microprocessor-controlled slave clock adapted to be coupled to a master clock;

means at the slave clock for receiving a plurality of time correction pulses sent by the master clock in a pattern representative of a clock synchronization protocol used by the master clock;

means at the slave clock for storing data representative of characteristics of the pulses received at the slave clock;

means at the slave clock for performing an analysis of the data at the slave clock to determine which clock synchronization protocol has been used most frequently by the master clock during a predetermined period of time in the past;

means at the slave clock for selecting the protocol for the slave clock that best matches the protocol determined to be in use by the master clock; and executing the protocol at the slave clock so as to synchronize a time displayed by the slave clock with a time displayed by the master clock.

18. The clock of claim 17, in which the data includes data representative of one or more of the following characteristics of the pulses: frequency of occurrence of the pulses, width of the pulses, time between pulses, polarity of the pulses, and whether the pulses are sent by AC or DC current.

19. The clock of claim 18, in which the protocol used by the master clock comprises any one of the following protocols: 58th minute correction, 59th minute hourly correction, 59th minute daily correction, National Time and Rauland hourly correction, or National Time and Rauland daily correction, or impulse correction.

20. The clock of claim 19 in which the protocol selected for the slave clock is displayed at the slave clock.

21. The clock of claim 20, which the protocol for the slave clock is selected whether or not the pulse pattern displays normal or inverted electrical signal polarity.

22. A method for automatically detecting and selecting a clock synchronization protocol for use within a master/slave dock system, comprising the steps of:

(a) receiving pulse patterns sent by a master clock to a slave clock, each pulse pattern representing a clock synchronization protocol used by the master clock;

(b) storing data at the slave clock, the data representative of characteristics of the pulse patterns received at the slave clock during a predetermined period of time in the past;

(c) performing an analysis of the data at the slave clock to determine the clock synchronization protocol most likely in use by the master clock;

(d) selecting a clock synchronization protocol by the slave clock that has the highest probability of being the protocol used by the master clock in the past, via continuous self-teaching and analysis of the data; and (e) automatically synchronizing a time displayed by the slave clock with a time displayed by the master clock using the protocol selected by the slave clock.

23. The method of claim 22, further comprising the steps of: (a) receiving at a slave clock a plurality of pulses in a pattern sent by a master clock to the slave clock, each pattern representing one of a plurality of clock synchronization protocols; (b) storing protocol data at the slave clock representative of the clock synchronization protocols; and (c) storing the pulses and waveform data at the slave clock, the waveform data representative of waveform characteristics of the pulses received at the slave clock during a predetermined period of time in the past.

24. The method of claim 22, in which the data includes data representative of one or more of the following characteristics of the pulses: frequency of occurrence of the pulses, width of the pulses, time between pulses, polarity of the pulses, and whether the pulses are sent by AC or DC current.

25. The method of claim 24, in which the time correction protocol used by the master clock comprises any one of the following protocols: 58th minute correction, 59th minute hourly correction, 59th minute daily correction, National Time and Rauland hourly correction, National Time and Rauland daily correction, or impulse correction.

26. The method of claim 25, in which the time correction protocol selected for the slave clock is displayed at the slave clock.

27. The method of claim 26, in which the protocol for the slave clock is selected whether or not the pulse pattern displays normal or inverted electrical signal polarity.

* * * * *